US005795133A

United States Patent [19]

Hill et al.

[11] Patent Number: 5,795,133

[45] Date of Patent: Aug. 18, 1998

[54] HINGED FAN GUARD WITH SNAP FIT

[75] Inventors: D. Lee Hill, Olathe, Kans.; Jimmy D. Vanfossan, Gladstone, Mo.; Steven E. Woosley, Palestine, Ill.

[73] Assignee: Emerson Electric Co., St. Louis, Mo.

[21] Appl. No.: 762,365

[22] Filed: Dec. 9, 1996

[51] Int. Cl.[6] ..... F04D 29/18

[52] U.S. Cl. ..... 416/247 R

[58] Field of Search ..... 416/247 R

[56] References Cited

U.S. PATENT DOCUMENTS

| | | |
|---|---|---|
| Re. 34,551 | 2/1994 | Coup . |
| D. 309,944 | 8/1990 | Chiu . |
| 515,405 | 2/1894 | Meston . |
| 550,107 | 11/1895 | Longauer . |
| 652,241 | 6/1900 | Bonfiglio . |
| 1,114,459 | 10/1914 | Fritts . |
| 1,194,413 | 8/1916 | Nesseler . |
| 1,793,814 | 2/1931 | McCaig . |
| 1,809,583 | 6/1931 | Cook . |
| 1,971,332 | 8/1934 | Cook . |
| 2,017,431 | 10/1935 | Anderson . |
| 2,036,478 | 4/1936 | Hoff . |
| 2,259,853 | 10/1941 | Kock . |
| 2,345,516 | 3/1944 | Weber . |
| 2,498,968 | 2/1950 | Viewegh . |
| 2,617,583 | 11/1952 | Kemler . |
| 2,624,504 | 1/1953 | Viewegh . |
| 2,653,757 | 9/1953 | Segalman . |
| 2,658,666 | 11/1953 | Krzesiewski . |
| 2,728,519 | 12/1955 | McLarty . |
| 2,862,657 | 12/1958 | Copeland . |
| 3,262,638 | 7/1966 | Militello . |
| 3,402,882 | 9/1968 | Militelllo . |
| 3,414,121 | 12/1968 | Suzuki . |
| 3,446,429 | 5/1969 | Suzuki . |
| 3,725,640 | 4/1973 | Kunz . |
| 3,787,142 | 1/1974 | Dupke . |
| 3,791,333 | 2/1974 | Losch . |
| 3,963,382 | 6/1976 | Patton . |
| 3,971,199 | 7/1976 | Buschele . |
| 4,022,548 | 5/1977 | McLarty . |
| 4,120,615 | 10/1978 | Keem et al. . |
| 4,517,481 | 5/1985 | Breining . |
| 4,657,478 | 4/1987 | LaZebnik . |
| 4,657,485 | 4/1987 | Hartwig . |
| 4,672,234 | 6/1987 | Breining . |
| 4,732,539 | 3/1988 | Shin-Chin . |
| 4,815,934 | 3/1989 | Rademaker . |
| 4,818,183 | 4/1989 | Schaefer . |
| 4,819,370 | 4/1989 | Woodruff . |
| 4,861,230 | 8/1989 | Breining . |
| 4,953,698 | 9/1990 | Gregorich . |
| 5,002,462 | 3/1991 | Janisse . |
| 5,073,088 | 12/1991 | Peng . |
| 5,193,984 | 3/1993 | Lin . |
| 5,203,826 | 4/1993 | Dalebout . |
| 5,240,378 | 8/1993 | Janisse . |
| 5,352,094 | 10/1994 | Peng . |
| 5,474,427 | 12/1995 | Redetzke . |

*Primary Examiner*—John T. Kwon
*Attorney, Agent, or Firm*—Shook, Hardy & Bacon L.L.P

[57] ABSTRACT

A hinged snap together fan guard has front and rear fan guard members hingedly attached in a unique arrangement. Each of the front and rear fan guard members are generally formed in the shape of a concave dish having a plurality of ribs extending outwardly from a central region to a periphery of the member. Selected ribs on the front guard member terminate, at an outer end, in a hook for engaging with a peripheral rim of the rear fan guard member. At least one selected rib on each fan guard member terminates at an outer end in a loop. The two loops mate with each other, thereby forming a hinge. The front guard member can be moved from a closed position in engagement with the rear fan guard member to an open position, by pivoting the front fan guard member about the hinge. The hinge is preferably located in a lower quadrant of the fan guard, such that when opened, the front fan guard member is pivoted outwardly and downwardly relative to the rear fan guard member. In its open position, the front fan guard member cannot be inadvertently knocked into a closed position.

18 Claims, 3 Drawing Sheets

HINGED FAN GUARD WITH SNAP FIT

BACKGROUND OF THE RELATED INVENTION

1. Field of the Invention

The present invention is generally directed to a guard or cage for an electric fan. Particularly, the present invention is directed to a novel fan guard having front and rear guard members hingedly attached in a unique arrangement.

2. Description of the Related Art

Electric fans for circulating air are widely used in commercial and industrial environments. For example, air circulation fans are commonly located at each work station in factories, such as automobile plants. In such environments, the ability to quickly access the components of a fan in the event it requires maintenance or cleaning is very important, not only to assure that the industrial process within the plant is not excessively disrupted, but also to keep the time and cost associated with wide scale cleaning or maintenance of a large number of fans at a minimum.

In the past, conventional air circulator fans incorporated a fan guard assembly having front and rear fan guard members detachably connected to each other. With such fan guards, it is necessary to entirely detach the front fan guard member from the rear fan guard member to access the fan blade and motor, as is frequently necessary for repairing and cleaning the fan. The process of detaching and removing the front fan guard member from the rear fan guard member tends to be cumbersome, particularly since such fans are conventionally located above work stations, many feet above floor level or working level. Thus, repairing or cleaning a conventional air circulation fan often requires a maintenance worker to climb or be lifted to the location of the fan, remove the front fan guard member, and then store it out of the way, usually involving returning to the floor level, and then moving back into position to service the fan. Upon completion of maintenance, the worker must again return to the floor level to retrieve the front guard member, and finally return back to the overhead fan to replace the front guard member. Alternatively, two workers can be employed to allow the front guard member to be passed to and from a second worker standing on the floor. Obviously, such processes are time consuming and costly.

In response to these problems, hinged fan guard assemblies have been developed wherein the front fan guard member is hingedly attached to the rear fan guard member. The hinged arrangement permits a worker to access the components of the fan without the need for completely removing and relocating the front fan guard member. While various types of hinging mechanisms are commonly known, conventional hinging devices require special adaptation for use on a fan guard, thus increasing the overall complexity and cost of the unit.

One known hinged fan guard assembly is described and illustrated in U.S. Pat. No. 5,002,462 (Janisse). That device requires a plurality of adjacent eyelets positioned on the front and rear fan guard members. A curved retainer rod, having an enlarged head at a first end, is positioned through two pairs of the adjacent eyelets, and a safety pin is located through an opening at a second end of the retainer rod. According to the preferred embodiment illustrated in the '462 patent, four such retaining rods are utilized at equally spaced locations about the fan guard. To access the components of the fan, three of the retainer rods must be removed, while the remaining fourth retaining rod serves as a hinge member for permitting the fan guard to be swung into an open position.

In practice, the fan guard described in the '462 patent has proved to be cumbersome, due to the necessity of removing at least three retaining rods which, itself, requires removal of three associated safety pins. Thus, a maintenance worker needing to access components of the fan must remove and set aside multiple, separate components. This process tends to be time consuming, costly, and cumbersome, because it requires the worker to remove separate articles and have a convenient place for locating the loose articles. This is especially troublesome since such fans are conventionally located well above the working surface or floor level. Moreover, the arrangement requires a worker to access the guard at opposite extremes of the guard. For larger fans, a worker might be required to reposition a ladder or stretch, unsafely, from a ladder or other lift device. Additionally, replacement of the front fan guard member requires retrieval and corresponding replacement of the multiple, loose components at the widely displaced locations. In addition to the time consuming and cumbersome steps required for opening and closing the fan guard described in the '462 patent, it has been found that the guard, and other guards in which the front and rear members are hingedly attached along a length of the periphery of the fan guard, sometimes tend to inadvertently swing shut, thereby disrupting the worker and obstructing the work area.

Accordingly, the need exists for a hinged fan guard which is inexpensive to manufacture, and simple to use. The need also exists for such a hinged fan guard that securely fastens together for safe operation of the fan. In this regard, current safety requirements and prerequisites for a UL Listing set forth that fan guards of the subject type require the use of a tool to open or detach the front fan guard member. Thus, the need exists for a hinged fan guard assembly that is easy to open, but requires the use of a tool to effect opening.

Additionally, the need exists for a hinged fan guard assembly wherein the front guard member, when opened, will not inadvertently swing to the closed position and inconveniently obstruct access to fan components. Further, the need exists for a hinged fan guard having no loose components which must be relied upon for attaching members of the fan guard. The present invention fulfills these and other needs, and overcomes the drawbacks of prior art devices.

SUMMARY OF THE INVENTION

It is an object of the present invention to hingedly attach front and rear fan guard members.

It is an object of the present invention to provide a hinged fan guard member which is easy and inexpensive to manufacture.

It is an object of the present invention to maintain the components of a fan unobstructed by a front fan guard member, when the front fan guard member is detached or open for repair and maintenance on the fan.

It is a principal object of the present invention to provide a fan guard for an industrial, electrical fan which requires no loose components.

It is an additional object of the present invention to provide a fan guard for an electrical, industrial fan which may be easily opened for repair and maintenance of the fan, but which must be opened with the assistance of a tool.

These and other objects are achieved by a fan guard for an electrical, air circulation fan. The fan guard has front and rear fan guard members. Each front and rear fan guard member has a plurality of spaced-apart ribs extending radially outward from a generally central location. A conventional grill is secured over the ribs to form a concave dish-shaped member. An outer peripheral rim is secured along the outer periphery of each guard member to an outer end portion of each radially extending rib.

Each fan guard member preferably defines a central opening. The central opening in the front fan guard member accepts a nameplate, while the central opening in the rear fan guard member is preferably slightly larger than the opening in the front fan guard member, and receives a portion of an electrical motor. The motor is secured by fasteners to the rear fan guard member, and any conventional impeller or blade arrangement is attached to the electrical motor.

A plurality of selected ribs of the ribs on the front fan guard member are each bent at an outer end to form a hook. Each hook overlaps and partially surrounds the outer peripheral rim of the rear fan guard member, thereby securing the two fan guard members together. When the front fan guard member is secured to the rear fan guard member, the radially extending ribs of the respective guard members are offset from each other, to prevent the radially extending ribs of the rear fan guard member from interfering with the hook portions. It will be understood that hook members could, alternatively, or additionally, be formed on outer ends of selected ribs on the rear fan guard member.

In accordance with an aspect of the present invention, a hinge is located at the outer peripheral edge of the fan guard for permitting the front guard member to be swung open and closed relative to the rear guard member. The hinge is formed of mating loops wherein at least one selected rib on the front fan guard member forms a loop at its outer end. The loop, thereby positioned at the outer periphery of the front fan guard member, protrudes slightly outwardly from the peripheral edge of the front fan guard member. A special rib is positioned on the rear fan guard member so as to correspond to the location of, and align with, the selected loop-bearing rib on the front fan guard member. The special rib on the rear fan guard member also has an outer end formed in a loop that interlocks, or mates, with the loop on the front fan guard member. In other words, each fan guard member has a loop positioned at its outer peripheral edge, formed at an outer end of a respective radially extending rib, for mating with the loop of the other fan guard member. The mating, or interlocking, loops act as a hinge for hingedly attaching the front and rear fan guard members.

In use, a tool, such as a pry bar, can be utilized to pry one or more of the hooks on one fan guard member from its position in engagement with the other fan guard member, and any remaining hooks can be detached by "walking" or toggling the front fan guard member back and forth until all hook members are detached. The front fan guard member can then be quickly and easily swung, about the hinge, from its closed position to an open position, to permit a maintenance worker to clean or repair components of the fan. In accordance with a unique objective of the present invention, when the mating loops are positioned at a lower half of the fan guard, although not at the lowest point of the fan guard, the interlocking loops permit the front fan guard member to be swung open and twisted, or tilted, into a convenient location which prevents the front fan guard member from being inadvertently swung into the closed position. The fan guard can be easily closed by simply pivoting the front fan guard member about the hinge and securing the hook portions with the opposing guard member.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 2:
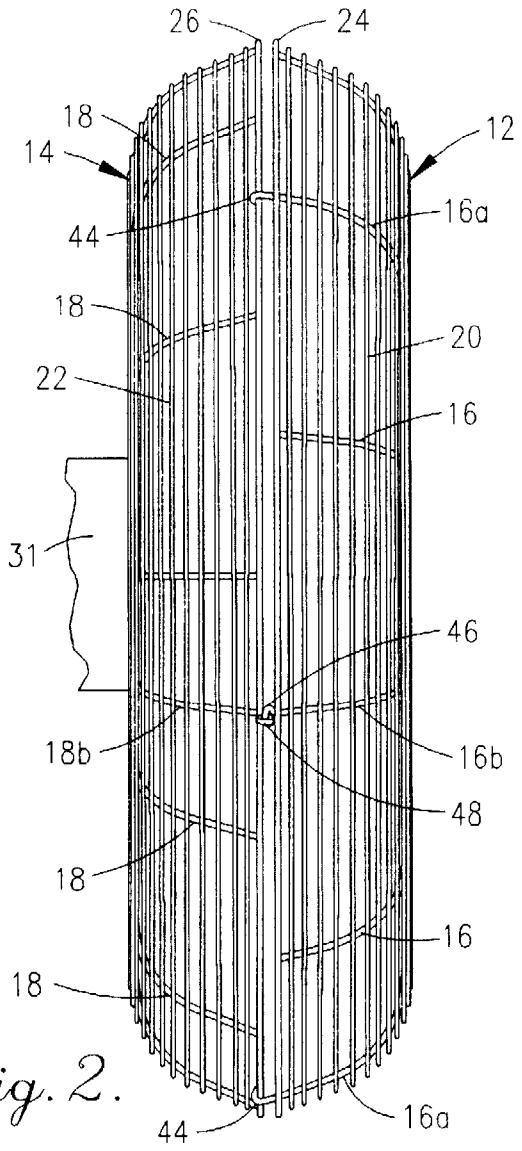
FIG. 2 is a left side elevational view of the fan guard of the present invention, with fan components within the guard removed for ease of illustration and understanding.
Figure 1:
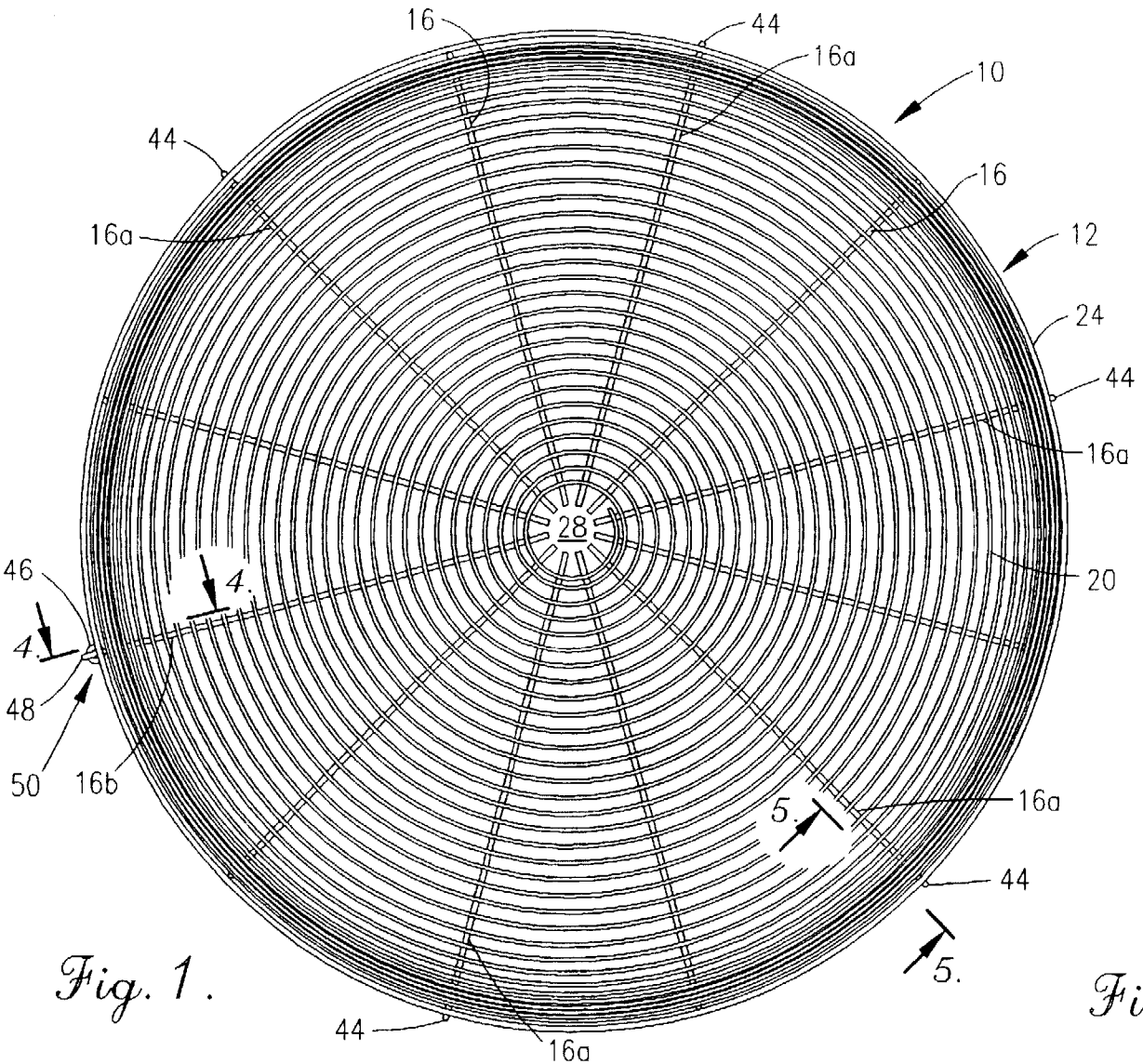
FIG. 1 is a front elevational view of a fan guard of the present invention, with a majority of a rear portion of the fan guard removed for ease of illustration and understanding.

With reference initially to FIGS. 1 and 2, a hinged snap together fan guard of the present invention is denoted generally by reference numeral 10. As shown, fan guard 10 has a front fan guard member 12 and a rear fan guard member 14, each of which is preferably formed of metal. Each fan guard member 12, 14 forms a concave disc and has a plurality of respective ribs 16, 18. The ribs 16, 18 extend radially outward, from a generally central location, to an outer periphery of their respective guard members 12, 14. Each guard member 12, 14 has a grill, or screen, as denoted generally by the reference numerals 20, 22. The grills 20, 22 are preferably formed by spiralling a wire rod member in the manner illustrated. The formation of grills 20, 22 will be readily understood by those with skill in the art. Grills 20, 22 are secured to respective ribs 12, 14 in any conventional manner, such as by welding. Each guard member 12, 14 has an outer peripheral rim 24, 26 secured to outer portions of associated ribs 12, 14.

Figure 3:
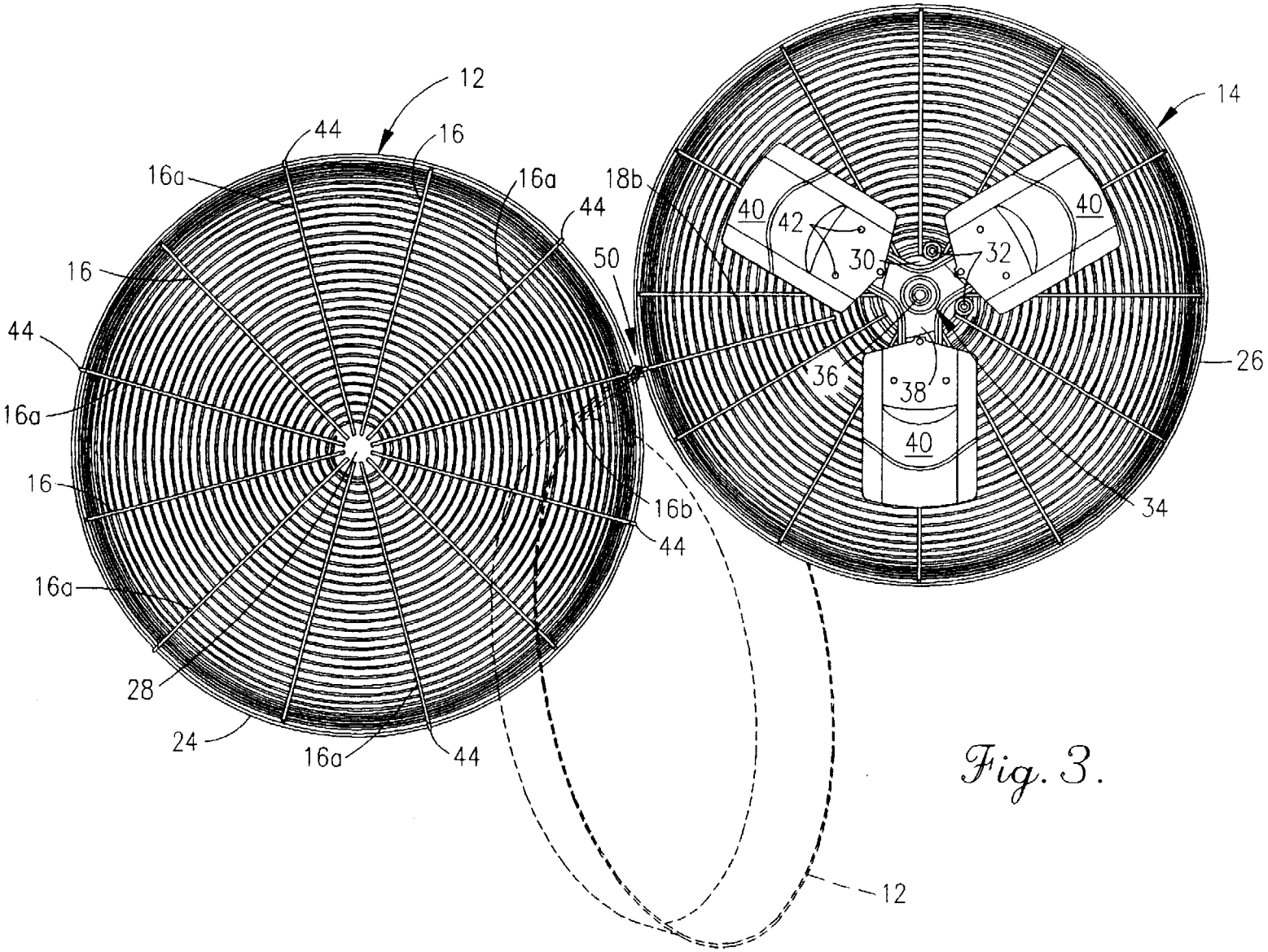
FIG. 3 is a front elevational view, with broken lines providing a perspective, illustrating the hinged fan guard of the present invention, when opened.

With additional reference to FIG. 3, each of front guard member 12 and rear guard member 14 defines a central opening. Particularly, front guard member 12 defines a central opening 28 adapted to receive a cover, or insert, such as a conventional name or logo-bearing plate. Rear guard member 14 has a central aperture (not shown) for receiving an output portion 30 of an electric motor having a rotary output, and having a housing 31. As shown in FIG. 3, rear guard member 14 is secured to motor housing 31 by fasteners 32.

As shown in FIG. 3, an impeller, denoted generally by reference numeral 34, is secured to the portion 30 of the motor in any conventional fashion. Impeller 34 includes a conventional central hub 36 having a plurality of outwardly extending wings 38 and fan blades 40, connected by fasteners such as rivets 42, to respective wings 38. The described structure and arrangement of conventional fan motors and impellers will be readily appreciated by those with skill in the art, as will the attachment of a rear guard member, such as rear guard member 14, to the fan motor.

Figure 5:
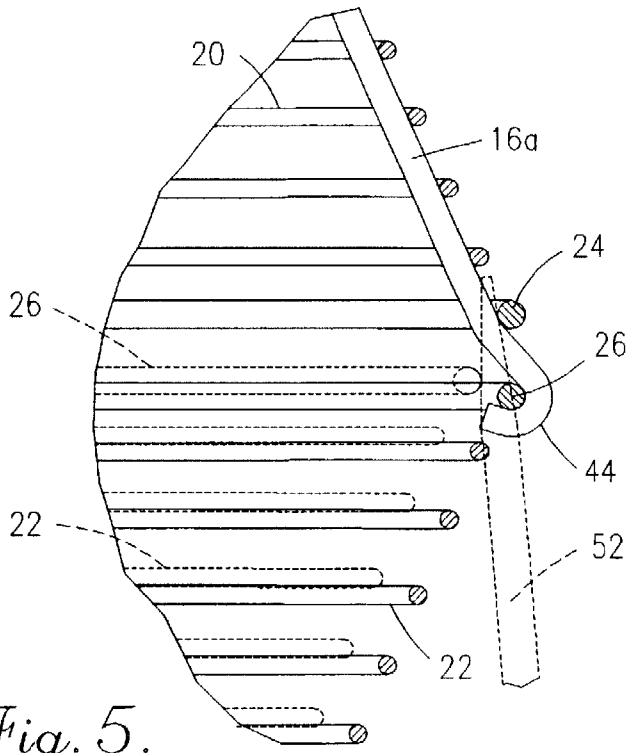
FIG. 5 is a partial cross-sectional view taken along line 5—5 of FIG. 1 illustrating that a tool, such as pry bar, is preferably utilized when opening and perhaps closing the hinged fan guard of the present invention.

With reference to FIGS. 1, 3 and 5, each of a plurality of selected ribs **16*a* of front ribs 16 is bent at an outer end to form a hook, as designated by hooks 44. As shown, hooks 44 overlap and partially surround outer peripheral rim 26 of rear guard member 14. Hooks 44 serve to releasably secure front guard member 12 to rear guard member 14. As illustrated by FIG. 2, the position of ribs 16 on front guard member 12, and particularly those selected ribs 16*a* having a hook 44 at an outer end thereof, are offset from (e.g., not in alignment with) the ribs 18 of rear fan guard member 14. As will be readily appreciated, the offset arrangement of the ribs 16, 18 prevents ribs 18 on rear guard member 14 from interfering with hooks 44 on front guard member 12. It will be appreciated that hooks 44 could alternatively, or additionally, be located on rear guard member 14 for engaging with front guard member 12. In any such embodiment, hooks 44 at the periphery of the fan guard 10 permit guard members 12, 14** to be secured, (e.g., snapped) securely together.

Figure 4:
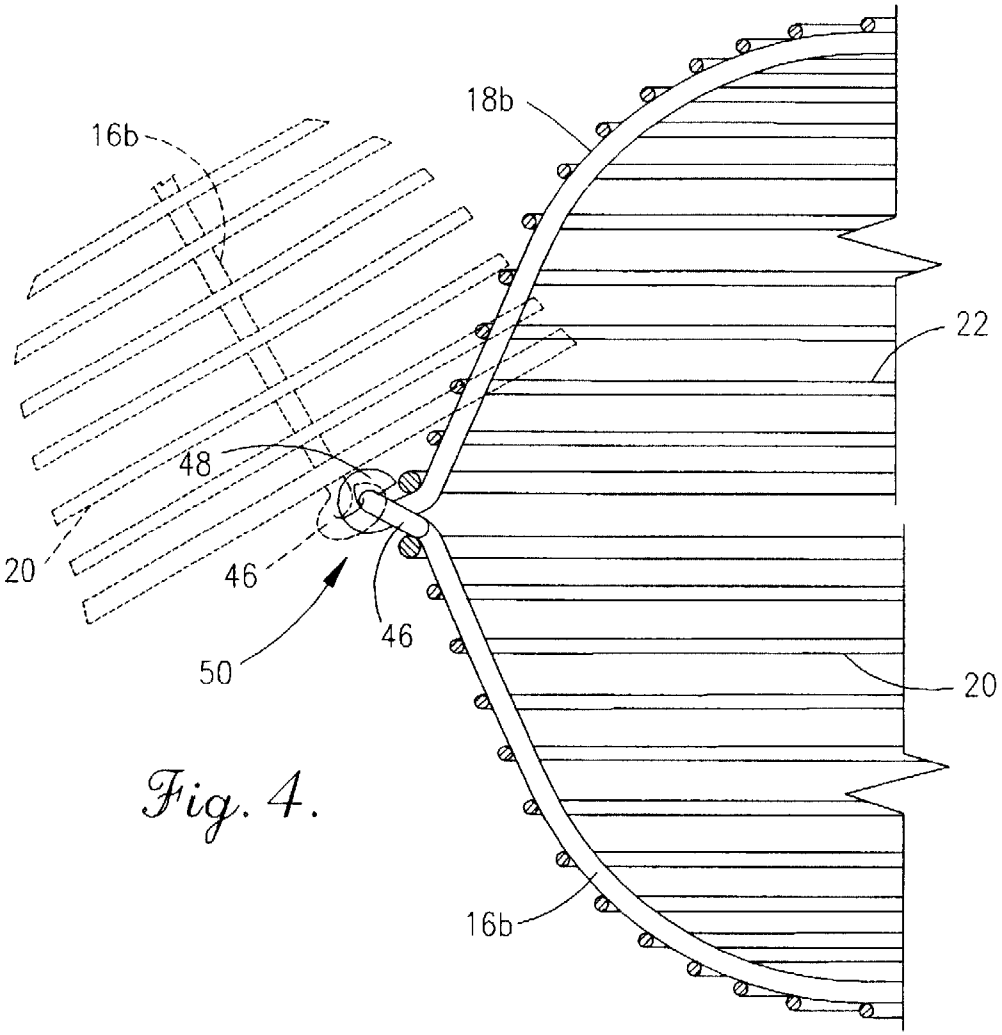
FIG. 4 is a fragmentary cross-sectional view taken along lines 4—4 of FIG. 1 illustrating the unique hinge of the fan guard of the present invention.

Referring to FIGS. 2, 3 and 4, and in accordance with an aspect of the present invention, at least one selected rib 16 on front guard member 12, as particularly designated by reference numeral **16*b*, forms a loop 46 at its outer end. Loop 46 is formed by bending an outwardly extending end of rib 16*b* to form loop 46. Additionally, a special rib, designated by reference numeral 18*b*, is secured to rear guard member 14 so as to align with rib 16*b* on front guard member 12. As illustrated, special rib 18*b* on rear fan guard member 14 is shorter than the other ribs 18 and, particularly, does not extend entirely to a central region of the rear guard member 14. It will be understood, however, that the length of special rib 18*b* is not critical, and that it could be as long as the other ribs 18**, or that it could be significantly shorter.

Special rib **18*b* on rear guard member 14 also forms a loop 48 at its outer end. As with loop 46 on rib 16*b*, loop 48 on rib 18*b* is formed by simply bending an outwardly extending end portion of rib 18*b* to form the loop 48. In accordance with the principals of the present invention, loops 46 and 48 mate or lock with each other to form a hinge 50. Specifically, a portion of rib 16*b* forming the loop 46 passes through the interior of loop 48, while a portion of rib 18*b* forming the loop 48 passes through the interior or loop 46**.

With reference to FIGS. 3–5, use of the hinged snap together fan guard of the present invention is shown and described.

In use, a fan incorporating fan guard 10 of the present invention is positioned at a desired location. As discussed above, air circulator fans of the type with which the present fan guard 10 is concerned are often utilized as overhead fans in industrial manufacturing environments. In many such environments, such as in an automobile plant, hundreds or even thousands of fans are located above individual work stations. Thus, the ability to quickly access the components of a fan in the event it needs maintenance or cleaning is critical, not only to assure that the industrial process within the plant is not excessively disrupted, but also to keep the time and costs associated with wide scale cleaning or maintenance of a large number of fans at a minimum.

When a fan incorporating the fan guard 10 of the present invention is in a closed position, as illustrated in FIG. 2, front fan guard member 12 may be initially released from its position in engagement with rear fan guard member 14 by positioning a tool, such as the pry bar 52 illustrated in FIG. 5, between the front and rear cage members 12, 14 at a location at, or proximate to, one of the hooks 44. In this way, an initial one of the hooks 44 may be pried from its engagement with peripheral rim 26 of rear guard member 14. Other hooks 44 may be similarly pried loose from their engagement with rear cage member 14 or, alternatively, once one or a few hooks 44 have been disengaged, the remaining hooks 44 can be disengaged by moving front fan guard member 12 upwardly and downwardly in a toggling manner to permit successive hooks 44 to become disengaged with rear fan guard member 14. Thus, a worker does not have to reach each hook 44 to open the guard 10. FIG. 5 illustrates in broken lines the position of rear fan guard member 14 being pried out of engagement with a hook 44.

Once all hooks 44 have been disengaged from rear guard member 14, front guard member 12 may be swung open by hinge 50, in the general direction as illustrated in solid lines in FIG. 3. A unique operational result of the structure of the present invention permits the front guard member 12 to be directed into a location substantially like that illustrated in broken lines in FIG. 3. In this regard, mating loops 46, 48 forming hinge 50 are formed so as to permit one of the loops to pivot inside the other. In the configuration illustrated, rear guard member 14 is stationary, while front guard member 12 is pivoted outwardly away from rear guard member 14, to thereby open the guard member and permit access to the components of the fan.

As illustrated, loops 46 and 48 are formed in planes that are perpendicular to each other. It will be readily understood and appreciated that the precise manner in which one loop 46, 48 is oriented with respect to its associated guard member 12, 14 is not critical, but rather the orientation of loops 46, 48 relative to each other must be such that they conveniently mate or interlock with each other. Additionally, although loops 46, 48 have been illustrated in a preferred form comprising an outer end portion of respective ribs **16*b*, 18*b*, it will be readily understood and appreciated that the principal of locating mating, perpendicularly oriented loops at the outer periphery of respective guard members can be achieved by locating the loops 46, 48 at locations other than on the ends of respective ribs 16*b*, 18*b*. For instance, loops 46, 48 could be positioned on outer peripheral rims 24, 26 of respective front and rear guard members 12, 14. Such an arrangement can be realized by simply bending a portion of the rims 24, 26 at a break location so as to orient the loops 46, 48 in the necessary manner. Furthermore, loops 46, 48 could be separately formed and then fastened to corresponding outer peripheral portions of front and rear fan guard members 12, 14. In an alternate embodiment of the present invention, a single loop is positioned at the periphery of one of the front and rear guard members 12, 14 and surrounds the peripheral rim 24, 26 of the other guard member, while resting against one of the ribs 16, 18 of the other guard member 12, 14 at the location where the rib 16, 18 meets the peripheral rim 24, 26**.

In accordance with a preferred embodiment of the present invention, loops 46, 48 are substantially, but not completely closed, thereby leaving a small opening providing access to the interior of the loop, as illustrated best in FIG. 4. In such an embodiment, front and rear fan guard members 12, 14 can be manipulated relative to each other to an extreme position in which the loops 46, 48 will become disengaged, thereby completely separating fan guard members 12, 14. The extreme movement required for completely separating fan guard members 12, 14 is not the type of movement associated with conventional use of fan guard 10, but does permit loops 46, 48 to be completely formed during the manufacture process, and thus permits the front and rear fan guard members 12, 14 to be shipped or stored in a disengaged manner. Additionally, if desired, the outermost end of one or both loops 46, 48 can be bent, or crimped, closed so as to prevent complete disengagement of fan guard members 12, 14.

In accordance with the principles of the present invention, considering the fan guard 10 from the front elevational view as illustrated in FIG. 1, it is preferred that hinge 50 be positioned at the periphery of guard member 10 in a lower, left quadrant thereof. In this regard, it will be understood that fan guard 10 can be located on an associated fan so that hinge 50 is positioned in any preferred manner. However, location of the hinge 50 in a lower left quadrant of the fan guard 10, particularly when the fan guard 10 is utilized in its typical upright position, has been found desirable for most environments.

Due to the unique arrangement of hinge 50 of the present invention, the front guard member 12 can be pivoted at the hinge 50 to easily place it in the position shown by broken lines in FIG. 3. In the orientation shown in FIG. 3, natural gravitational pull on front guard member 12 will assist in the movement of front guard member 12 to the suspended position illustrated, and importantly, will maintain the front guard member 12 in the suspended position, thereby preventing front guard member 12 from being inadvertently closed or knocked into a position in which it obstructs the working region.

In the embodiment illustrated, pivotal movement of front guard member 12 relative to rear guard member 14 causes loop 46 to pivot within loop 48 in a direction corresponding to the force applied to fan guard member 12, within the constraints of the boundaries of interlocking loops 46, 48. As will now be readily understood and appreciated, the structure of hinge 50, and its preferred position on fan guard 10, causes loop 46, when open front guard member 12 is otherwise unsupported, to slide or pivot so as to be suspended from the lowermost part of loop 48. Thus, when front guard member 12 is moved from a closed position to an open position, the front guard member pivots outwardly and downwardly relative to the upright fan guard 10. Specifically, the front guard member 12 twists, or is directed, to a location wherein a portion of front guard member 12 rests behind rear guard member 14, while a portion of the rear guard member generally below hinge 50, generally protrudes towards, or into, the concave interior region formed by front fan guard member 12, as illustrated in broken lines in FIG. 3.

To replace front guard member 12 into a closed position, the process described above is essentially reversed. Particularly, the open front guard member 12 is grasped by a worker and pivoted and twisted about hinge 50 into a suitable position for permitting at least one of the hooks 44 to engage about outer peripheral rim 26 of rear guard member 14. Reattachment of front guard member 12 is perhaps most easily accomplished by attaching one of the hooks 44 in closest proximity to hinge 50 to outer peripheral rim 26 of rear guard member 14, and then working around the fan guard 10, hooking each hook 44 along the way. This process can be facilitated, as needed, with use of pry bar 52.

Fan guard 10 of the present invention, as now completely shown and described, can be securely closed so that it is not too easily detached, such as by inadvertent bumping of the fan guard. This secure attachment is accomplished by the plurality of spaced apart hooks 44 which engage the outer peripheral 26 of rear guard member 14, and permit front guard member 12 to snap together with rear fan guard member 14. By detaching hooks 44 from rear guard member 14, the fan guard 10 can again be easily opened by swinging front guard member 12 about hinge 50 formed by mating loops 46, 48 at respective peripheral edges of front guard member 12 and rear guard member 14. Front guard member 12 may then be allowed or directed to pivot downwardly into a hanging or suspended positioned as illustrated in broken lines in FIG. 3.

Fan guard 10 of the present invention is extremely simple and inexpensive to manufacture. The utilization of a hinge 50, formed of mating loops which are entirely integrally formed with front and rear guard members 12, 14, thus requiring no loose parts, allows the fan guard to be easily opened and closed without overly excessive activity on the part of a maintenance worker and without the need to handle and account for multiple loose components.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A fan guard comprising:

a front fan guard member having an outer periphery;

a rear fan guard member having an outer periphery;

a first loop positioned at said outer periphery of said front fan guard member;

a second loop positioned at said outer periphery of said rear fan guard member, wherein said first and second loops mate with each other, thereby forming a hinge for hingedly attaching said front and rear fan guard members.

2. The fan guard as set forth in claim 1, wherein said fan guard defines an at least substantially upright orientation for use, wherein said hinge is located at a lower half of said fan guard.

3. The fan guard as set forth in claim 2, wherein said hinge is more particularly located at a lower quadrant of said fan guard.

4. The fan guard as set forth in claim 2, wherein said hinge is more particularly located at a lower, left quadrant of said fan guard when facing the front guard member of said fan guard.

5. The fan guard as set forth in claim 1, wherein said first and second loops are oriented at least substantially perpendicular to each other.

6. The fan guard as set forth in claim 1, wherein said hinge permits said front fan guard member to be moved from a closed position in engagement with said rear fan guard member to an open position in which at least a portion of said front guard member is located behind said rear fan guard member.

7. The fan guard as set forth in claim 6, wherein each of said front and rear fan guard members comprise a concave, dish-shaped member defining an interior region, and wherein a portion of said rear fan guard member extends into the interior region of said front fan guard member when said front fan guard member is in an open position.

8. The fan guard as set forth in claim 1, wherein each of said front and rear fan guard members comprises a concave dish-shaped member having a respective plurality of space-apart ribs extending radially outward to said outer periphery of said member, and wherein said first loop is formed at an outer end of a selected one of said ribs on said front guard member and said second loop is formed at an outer end of a selected one of said ribs on said rear guard member.

9. The fan guard as set forth in claim 8, wherein each of said front and rear fan guard members further comprises a grill secured to its respective said plurality of ribs.

10. The fan guard as set forth in claim 8, wherein each of selected ones of said ribs on at least one of said front and rear fan guard members have an outer end forming a hook for releasably attaching said front and rear fan guard members together at a plurality of spaced-apart locations.

11. The fan guard as set forth in claim 10, wherein each said selected ones of said ribs forming hooks is on said front fan guard member, wherein said rear fan guard member has an outer peripheral rim, and wherein said hooks overlap said outer peripheral rim about an outer portion thereof.

12. The fan guard as set forth in claim 1 further comprising a plurality of space-apart hooks located on said periphery of at least one of said fan guard members for releasably attaching said front and rear fan guard members together at a plurality of spaced apart locations.

13. The fan guard as set forth in claim 1 in combination with a fan, said combination further comprising:

a motor;

an impeller connected to said motor, wherein said hinge permits said front fan guard member to be moved between a closed position, in engagement with said rear fan guard member and covering said impeller, and an open position in which said impeller is uncovered.

14. The combination as set forth in claim 13 wherein said first loop on said front fan guard member pivots within said second loop on said rear fan guard member when said front fan guard member is moved between said closed and open positions.

15. A fan comprising:

a motor;

an impeller connected to said motor;

a rear fan guard member having an outer periphery;

a front fan guard member having an outer periphery;

a first, at least partially closed loop positioned at said outer periphery of said front fan guard member;

a second, at least partially closed loop positioned at said outer periphery of said rear fan guard member, wherein said first and second loops mate with each other, thereby forming a hinge permitting said front fan guard member to be moved between a closed position, in engagement with said rear fan guard member and covering said impeller, and an open position in which said impeller is uncovered.

16. The fan as set forth in claim 15, defining an at least partially upright orientation for use, wherein, when said front fan guard member is in said open position, said front fan guard member is suspended from said rear fan guard member at a lowest portion of said second loop on said rear fan guard member.

17. The fan as set forth in claim 15, wherein said front fan guard member is pivoted outwardly and downwardly when moved from said closed position to said open position.

18. A fan guard comprising:

a front fan guard member having an outer peripheral rim;

a rear fan guard member having an outer peripheral rim; and a loop located proximate one of said outer peripheral rims and at least partially surrounding said other outer peripheral rim, thereby forming a hinge for hingedly attaching said front and rear fan guard members.

* * * * *